United States Patent [19]

Zisholtz

[11] Patent Number: 4,640,034

[45] Date of Patent: Feb. 3, 1987

[54] MOBILE FOR INFANTS

[76] Inventor: Barry Zisholtz, 353 E. 17th St., New York, N.Y. 10003

[21] Appl. No.: 733,998

[22] Filed: May 14, 1985

[51] Int. Cl.[4] ..... G09F 27/00

[52] U.S. Cl. ..... 40/455; 40/617; 446/227

[58] Field of Search ..... 40/455, 456, 457, 617, 40/411; 272/31 R; 446/299, 297, 408, 227, 236, 242; D11/141

[56] References Cited

U.S. PATENT DOCUMENTS

| | | | |
|---|---|---|---|
| D. 261,783 | 11/1981 | Nakas et al. | D11/141 |
| 1,681,310 | 8/1928 | Reiner | 272/31 R |
| 3,550,495 | 12/1970 | Shotmeyer | 446/408 |
| 3,919,795 | 11/1975 | Jinivisian et al. | 40/473 |
| 3,927,482 | 12/1975 | Marcus | 40/455 |
| 3,983,647 | 10/1976 | Stubbmann | 40/455 |
| 4,207,696 | 6/1980 | Hyman et al. | 40/473 |
| 4,222,188 | 9/1980 | Tarrant et al. | 40/455 |
| 4,363,181 | 12/1982 | Hyman et al. | 40/466 |
| 4,541,188 | 9/1985 | Sadorus | 40/455 |

FOREIGN PATENT DOCUMENTS 2019229 10/1979 United Kingdom ..... 40/617

*Primary Examiner*—Gene Mancene
*Assistant Examiner*—Cary E. Stone
*Attorney, Agent, or Firm*—Caesar, Rivise, Bernstein, Cohen & Pokotilow, Ltd.

[57] ABSTRACT

A sound reproducing mobile for connection to cribs or other structures holding an infant. The mobile includes a housing in which is releasably secured an audio cassette player. The housing includes clamp means for releasably securing the mobile to the structure holding the infant. The cassette player, when operated, reproduces comforting voices via a loudspeaker and at the same time provides electrical power to a motor for causing the movement of overhanging decorative mobile elements. A voice actuated switch is provided to operate the player and mobile in automatic response to the detection of ambient sound. The player can also be operated manually. The cassette player is releasably secured to the mobile so that it can be removed for independent use thereof.

7 Claims, 3 Drawing Figures

MOBILE FOR INFANTS

BACKGROUND OF THE INVENTION

This invention relates generally to toys and more particularly to motor driven mobiles.

Motor driven mobiles for securement to cribs of infants have been disclosed in the patent literature and are commercially available. For example, U.S. Pat. No. 3,927,482 (Marcus) discloses an electric motor powered mobile. The electrical power is provided via household current to the mobile. A conventional mechanical music box is incorporated in the mobile and it is operated by rotation of the mobile to produce music. An on-off switch provides control of the motor. In the U.S. Pat. No. 4,363,181 (Hyman) there is disclosed an electrically powered mobile which includes an electronic circuit including an integrated circuit chip and an associated loudspeaker to produce synthesized music as the mobile rotates. Appropriate switch controls are provided to vary the tune, tonal quality, key, tempo and loudness of the music produced by the electronic circuit.

U.S. Pat. No. 4,207,696 (Hyman) discloses a motor operated mobile which includes sound activated switch means to effect the actuation of the motor to rotate the mobile in response to the detection of sound in the vicinity of the mobile.

Other prior art patents relating to mobiles are as follows: U.S. Pat. Nos. 1,681,310 (Reiner); and 3,919,795 (Jinivisian et al.).

While the foregoing prior art devices appear generally suitable for their intended purposes, they still leave much to be desired from the standpoint of functionality, utility and applicability of usage.

OBJECTS OF THE INVENTION

Accordingly, it is the general object of the instant invention to provide a mobile which overcomes the disadvantages of the prior art.

It is a further object of the instant invention to provide a motor driven mobile which includes tape means for reproducing sound at the mobile as it operates.

It is a further object of the instant invention to provide an electrically operated mobile which includes cassette tape player means for reproducing at least one voice as the mobile operates and which cassette player means can be removed from the mobile for conventional use.

It is still a further object of the instant invention to provide an electrically operated mobile including voice actuated means for operating a tape player to reproduce a comforting voice and causing the mobile to move in response to sensed sound.

SUMMARY OF THE INVENTION

These and other objects of the instant invention are achieved by providing a mobile for use on a structure for holding an infant. The mobile comprises housing means including releasable mounting means for mounting the mobile on the structure. Plural decorative elements are mounted on the mobile and are arranged to be moved through a predetermined path adjacent the infant. Electrical motor means is coupled to the elements and is operative when energized for moving the elements through the path. An audio tape player is supported in the housing means and is coupled to the motor. The tape player includes electric power supply means, acoustic speaker means and at least one reel of magnetic tape having at least one comforting voice magnetically recorded thereon. Switch means are provided coupled to the tape player means and the motor means for energizing the motor means from the electrical power means to cause the tape player to operate, whereupon the voice on the tape is reproduced through the speaker means to be heard by the infant.

BRIEF DESCRIPTION OF THE DRAWING

Other objects and many of the attendant advantages of this invention will be readily appreciated as the same becomes better understood by reference to the following detailed description when considered in connection with the accompanying drawing wherein.

DETAILED DESCRIPTION OF THE PREFERRED EMBODIMENT

Figure 1:
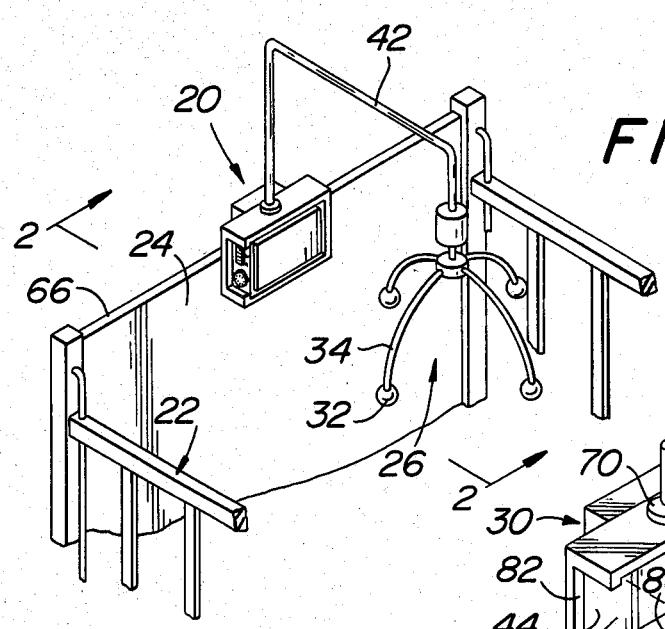
FIG. 1 is a perspective view of a mobile constructed in accordance with the subject invention and shown secured to a conventional crib for an infant.

Referring now in greater detail to the various figures of the drawing wherein like reference characters refer to like parts, there is shown generally at 20 in FIG. 1 a mobile constructed in accordance with this invention and mounted on a conventional crib 22 for holding an infant (not shown) therein. The crib 22 includes an end wall or headboard 24 onto which the mobile is shown mounted. It must be pointed out at this juncture that the mobile could be mounted on other portions of the crib as well. Moreover, the mobile can be secured to any structure (e.g., playpen, high chair, etc.) in which an infant is placed.

The sound producing mobile 20 basically comprises a free hanging mobile assembly 26 suspended by a support post 28 from a tape player-holding housing assembly 30.

Figure 3:
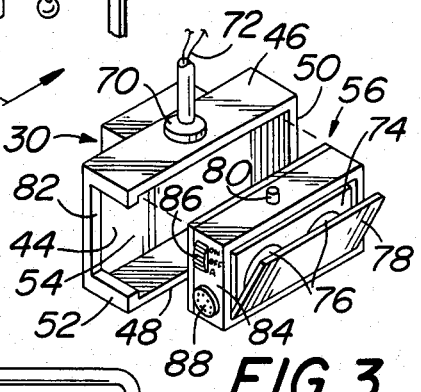
FIG. 3 is an enlarged perspective view of a portion of the mobile shown in FIG. 1.

The mobile assembly 26 is constructed in any suitable manner in accordance with the prior art. As shown in FIGS. 1 and 3, the mobile assembly basically comprises a plurality of decorative objects, e.g., balls 32, each mounted at the free end of an arcuate arm 34. The other end of each arm is connected to a central hub element 36. The hub element includes a centrally located drive shaft 38 which forms the output drive shaft of an electric motor 40. The motor 40 is mounted at the free end of the support post 28. As can be seen, the support post is a generally U-shaped tubular member whose central section 42 is sufficiently long so that when the housing 30 is mounted on the headboard 24, the mobile assembly 26 is located over a portion of the crib where it can be readily seen by the infant.

Figure 2:
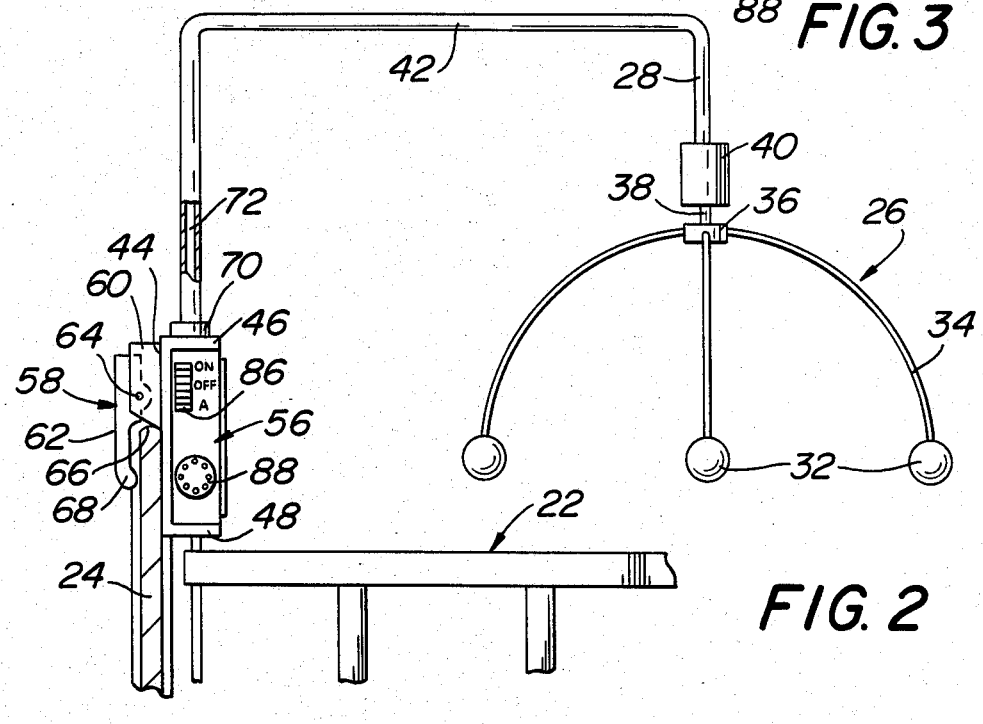
FIG. 2 is an enlarged sectional view taken along line 2—2 of FIG. 1.

The tape player-holding housing 30 basically comprises a hollow casing having a rectangular planar backwall 44 bounded around its peripheral edges by a top wall 46, a bottom wall 48, a sidewall 50 and a sidewall 52. The walls 46–52 and the base 44 define a hollow cavity 54 which is configured to receive a tape player 56 (to be described later). Mounted on the outer surface of the backwall 44 of housing 30 is a clamp assembly 58 (FIG. 2) for securing the mobile to the crib.

As can be seen the clamp assembly 58 includes a mounting bracket or yoke 60 which is fixedly secured to the backwall 44 of the housing 30. A spring biased clamping arm 62 is mounted on the yoke 60 via a pivot pin 64. The arm 62 is pivotable about pin 64 so that the top edge 66 of the headboard 24 can be interposed between the free end 68 of the arm 62 and the backwall 44 of the housing 30. A spring (not shown) biases the arm 62 so that its free end 68 is in tight engagement with the headboard to hold the housing securely in place thereon.

The support post 28 is mounted on the top wall 46 of the housing 30 via a mount 70. As mentioned earlier, the post 28 is a tubular member. Extending throughout the length of the tubular post is an electrical cable 72 which is connected to the motor 40 and is arranged to provide power to the motor 40 to cause the motor to operate. Electrical power is provided to cable 72 via a connector (not shown) mounted within the interior of the housing's cavity 54 at the location of mount 70. This connector is arranged to mate with an electrical connector, to be described later, which forms a portion of the tape player 56. This latter connector serves to provide electrical power from a power source in the recorder to the cable and hence to the motor.

The player 56 is of basically conventional construction insofar as its ability to reproduce sound recorded on a conventional compact cassette tape 74. In addition, the player 56 also includes the heretofore mentioned connector for conveying electrical power to the motor as well as sound responsive switch means, to be described later for effecting automatic operation of the device. In particular the player 56 includes a tape drive motor (not shown), a conventional magnetic head (not shown) for engagement with magnetic tape, and associated electronic components (not shown) including an amplifier. As is known, a conventional compact tape cassette includes two reels or hubs 76 on which magnetic recording tape is wound. The tape is arranged to be transferred between those reels by the operation of the drive motor. This action carries the tape across the magnetic head. The magnetic head senses the magnetic signals recorded on the tape and converts the same into electrical signals which are processed by the player's electronic circuitry. The resulting amplified signal is provided to a conventional transducer, such as an acoustic loudspeaker (not shown) mounted in the player 56. The loudspeaker converts the electronic audio signals into sound.

In accordance with conventional construction of compact cassette players, the player 56 includes a tape well in which the cassette 74 is placed for playing. The tape well is covered by a pivotable door or lid 78. Power for the electronics of the player 56 is provided by electric battery means (not shown) mounted within the player 56.

As mentioned earlier, the player 56 also includes a connector for providing electrical power from the player to the motor 40 of the mobile. That connector is shown in FIG. 3 and is denoted by the reference numeral 80.

The player 56 is arranged to be snap fit within the cavity 54 in the housing. When located within the housing, the connector 80 of the player 56 mates with the connector (not shown) within mount 70 to provide electrical continuity to the cable 72.

As shown clearly in the figures, the sidewall 52 of the housing 30 includes a notch 82 therein. The notch serves to provide free access to one end wall of the player 56. That end wall is denoted by the reference numeral 84 and includes a control switch 86 mounted thereon as well as a sensor for a sound actuated switch (to be described later). The control switch 86 is arranged to be manually operated to effect either manual or automatic operation of the mobile. In this regard, when the switch is in the OFF position, no power is provided to the motor in the player nor to the motor in the mobile, hence the player will not play the cassette tape located therein nor will the mobile element 26 be rotated by motor 40.

The switch 86 includes two "ON" positions. In one "ON" position, referred to hereinafter as the manual on position, the cassette player 56 is energized from its power source, whereupon sound is reproduced from the recording on the cassette 74 and at the same time electrical power is provided from the player's power source via cable 72 to the motor 40, whereupon the motor operates to rotate of the mobile assembly 26. The other "ON" position of switch 86 is what is referred to hereinafter as the automatic on position. It is in this position that the player is enabled for operation but will not operate until the sound actuated switch senses sufficient ambient sound to cause operation of the tape player and the mobile motor. Hence when the ambient sound sensed is beyond a predetermined threshold value, selected to be sufficiently high so as not to trigger on spurious normal household sounds, but low enough to trigger on infant generated sounds, like crying, etc., the sound actuated switch closes causing the player 56 to commence operation, whereupon sound is reproduced through its loudspeaker and at the same time the mobile element is rotated by the motor 40.

The sound actuated switch 88 can be of any suitable conventional construction, such as that disclosed and described in U.S. Pat. No. 4,207,696 (Hyman et al.) mentioned heretofore.

In accordance with the preferred embodiment of this invention, the audio information recorded on the cassette preferably comprises at least one voice which will tend to comfort or otherwise give pleasure to the infant hearing the sound. Thus, the cassette tape 74 may include the voice of the infant's mother, father or any other voice recognizable by the infant. Music or other comforting or pleasurable sounds can also be recorded on the cassette. For example, the cassette may include the infant's mother's voice uttering comforting words or sounds which will automatically be reproduced by the player 56 when the player is in the automatic on mode should the infant start to cry, since that action will trigger the sound actuated switch 88.

It must be pointed out at this juncture that the tape player 56 need not be a compact cassette, but can be any type of tape player. In fact the player can, if desired, be a combination tape recorder/player.

In accordance with an optional aspect of the invention, the player 56 may include timing means (not shown) for establishing the duration of time that the player remains on after having been actuated in response to sound sensed by the sound actuated switch 88.

In accordance with another aspect of this invention, the player 56 can be readily removed from the cavity 54 in the housing 30 to enable the player 56 to be used as a conventional cassette tape player separate and apart from its use in the mobile 20.

As should be appreciated from the foregoing, the apparatus of the instant invention offers great utility for providing amusement and comfort to an infant via the reproduction of sound, particularly comforting voices, coupled with movement of attractive visual objects, in either a manual mode of operation or an automatic, sound sensitive mode of operation. By virtue of the removability of the player 56 from the mobile for independent use thereof, the apparatus of the instant invention offers even greater applicability of use.

Without further elaboration, the foregoing will so fully illustrate my invention that others may, by applying current or future knowledge, readily adapt the same for use under various conditions of service.

I claim:

1. A mobile for use on a structure holding an infant, said mobile comprising housing means including releasable mounting means for releasably mounting said mobile on said structure, plural decorative elements arranged to be moved through a predetermined path adjacent said infant, electrical motor means coupled to said elements and operative, when energized, for moving said elements through said path, audio tape player means releasably supported by said housing means and coupled to said motor means, said tape means including electrical power means, acoustic speaker means and at least one reel of magnetic tape, switch means coupled to said tape player means and said motor means for energizing said motor means from said electrical power means and for causing said tape player to operate, whereupon said voice on said tape is reproduced through said speaker means to be heard by said infant.

2. The device of claim 1 wherein said switch means is responsive to ambient sound.

3. The device of claim 2 wherein said tape player is operative to play a cassette tape when disconnected from said housing.

4. The device of claim 1 wherein said reel of magnetic tape is contained within a cassette, said cassette being removable from said player.

5. The device of claim 4 wherein said cassette is a compact cassette.

6. The device of claim 1 wherein said tape player is operative to play a tape cassette when disconnected from said housing.

7. The device of claim 6 wherein said switch means is responsive to ambient sound.

* * * * *